US007137657B2

(12) United States Patent
Wu et al.

(10) Patent No.: US 7,137,657 B2
(45) Date of Patent: Nov. 21, 2006

(54) REINFORCED APPARATUS FOR A LEVER HANDLE OF A DOOR LOCK

(75) Inventors: Rong-Faa Wu, Chiayi (TW); Ching-Chuan Kuo, Chiayi County (TW); Po-Yang Chen, Chiayi (TW)

(73) Assignee: Tong Lung Metal Industry Co., Ltd., Chiayi (TW)

( * ) Notice: Subject to any disclaimer, the term of this patent is extended or adjusted under 35 U.S.C. 154(b) by 103 days.

(21) Appl. No.: 10/809,137

(22) Filed: Mar. 25, 2004

(65) Prior Publication Data

US 2004/0201230 A1 Oct. 14, 2004

(30) Foreign Application Priority Data

Apr. 9, 2003 (TW) ..... 92205573 U

(51) Int. Cl.
*E05B 15/12* (2006.01)
*E05B 3/00* (2006.01)

(52) U.S. Cl. ..... 292/357; 292/336.3; 292/347; 292/356; 292/DIG. 61; 70/224; 70/452

(58) Field of Classification Search ..... 292/357, 292/336.3, 347, 356, DIG. 53, DIG. 54, DIG. 61; 70/224, 452
See application file for complete search history.

(56) References Cited

U.S. PATENT DOCUMENTS 2,707,649 A * 5/1955 Young ..... 292/348
4,998,760 A * 3/1991 Nixon et al. ..... 292/347
5,067,758 A * 11/1991 Fann et al. ..... 292/347
5,157,952 A * 10/1992 Lin ..... 70/216
5,265,924 A 11/1993 Kim
5,481,890 A * 1/1996 Millman ..... 70/224
5,666,833 A 9/1997 Gao et al.
5,718,468 A * 2/1998 Qureshi et al. ..... 292/347
5,727,406 A * 3/1998 Banducci ..... 70/224
6,038,894 A * 3/2000 Hu ..... 70/224
6,085,561 A * 7/2000 Yao ..... 70/472
6,386,602 B1 * 5/2002 Lan ..... 292/336.3

FOREIGN PATENT DOCUMENTS

IT EP 526409 * 2/1993
JP 2013271 * 8/1979

* cited by examiner

*Primary Examiner*—Brian E. Glessner
*Assistant Examiner*—Carlos Lugo
(74) *Attorney, Agent, or Firm*—Senniger Powers

(57) ABSTRACT

A reinforced apparatus for a lever handle of a door lock comprises a housing having a first bottom plate and a second bottom plate, in which the first bottom plate connects a first annular wall and a second annular wall, and the second bottom plate connects the second annular wall and a third annular wall; a recess formed between the first annular wall and the second annular wall; and a rotary member, in which a coiled spring is disposed between a first and a second side plates of the rotary member: wherein the second bottom plate of the housing is formed with an axially extending predetermined bending member to be bent inwardly for a predetermined angle, after the rotary member and the coiled spring are disposed within the recess of the housing, so that the rotary member is maintained within the recess of the housing and can be operated externally.

5 Claims, 8 Drawing Sheets

REINFORCED APPARATUS FOR A LEVER HANDLE OF A DOOR LOCK

FIELD OF INVENTION

The present invention is related to a reinforced apparatus for a lever handle of a door lock, and particularly to an improvement of U.S. Pat. No. 5,666,833 corresponding to ROC (Taiwan) New Utility Model Patent Application No. 83216969.

BACKGROUND

U.S. Pat. No. 5,265,924 discloses that a rotatable member 13 and a spring member 15 are disposed within a mounting member 7, and can be operated externally. The retainer 16 is secured on the mounting member 7, so that the rotatable member 13 and the spring member 15 are maintained within the mounting member 7. Referring to such an arrangement, since the retainer 16 and the mounting member 7 are two separate members, the securing effect cannot be assured, and the rotatable member 13 and the spring member 15 are liable to disengage from the mounting member 7 and result in damage or malfunction.

U.S. Pat. No. 5,666,833 was invented by the inventors of present invention, and corresponds to those illustrated in FIGS. 1–8 of the present invention, and is relevant to the first embodiment of the reinforced apparatus for a lever handle of a door lock of ROC (Taiwan) New Utility Model Application No. 83216969. As illustrated in FIG. 1 of the present invention, the primary construction of U.S. Pat. No. 5,666,833 comprises a housing 3, a rotary member 4 and a coiled spring 5; in which the housing 3 includes a disk body formed with a wall 30 and an annular projections 31. A tubular wall 32 is formed between the wall 30 and the annular projections 31. A hole 33 is centrally formed within the annular projections 31. The hole 33 is in communication with two radial notches 34 formed on the annular projections 31. A recess 35 is formed between the annular projections 31 and the tubular wall 32. Two protrusions 36 are formed on the wall 30 and are spaced apart from two positioning holes 37 formed on the wall 30.

The rotary member 4 includes a tubular body having a first end 40 and a second end 41, in which the first end 40 is formed with a radially and inwardly extending tongue 42 and two radially and outwardly extending noses 43. The second end 41 is formed with a radially and outwardly extending annular flange 44. Two axially extending engaging plates 45 are formed on the annular flange 44 with a space between the plate 45 and the outer circumference of the tubular body. Two radially and outward extending lugs 46 are formed on the flange 44 and are spaced apart from the engaging plates 45.

The coiled spring 5 includes two legs 51 and is disposed around the circumference of the tubular body of the rotary member 4, so that two legs 51 of the coiled spring 5 respectively abut against the engaging plates 45 of the rotary member 4.

In an assembling process in a manufacturing factory, as shown in FIGS. 1, 2 and 3, the protrusions 36 of the housing 3 is formed with an inclined angle relative to the wall 30. The coiled spring 5 is disposed around the rotary member 4. The two noses 43 of the first end 40 of the rotary member 4 are then aligned with the two radial notches 34 of the housing 3. The rotary member 4 is then put into the recess 35 of the housing 3, until the noses 43 of the rotary member 4 pass through an outer surface of the annular projections 31 (see FIG. 3). The rotary member 4 is then rotated relative to the housing 3, from a position shown in FIG. 2 to a position shown in FIG. 4. At this time, the space between two legs 51 of the coiled spring 5 disposed around the rotary member 4 is aligned with the protrusion 36 of the housing 3. The protrusions 36 of the housing 3 are then compressed by a fixture (not shown) to reduce the inclined angle between the protrusions 36 and the wall 30, so that two legs 51 of the coiled spring 5 can firmly abut against the protrusions 36 of the housing 3 to form the assembled condition as shown in FIGS. 4 and 5, and so that the rotary member 4 and the coiled spring 5 can be firmly maintained within the housing 3, without axial disengagement from the housing 3.

In practical mounting operation of a user, as shown in FIG. 6, the extending tongue 42 of the rotary member 4 can align with is and engage an axial slot 81 of a driving shaft 8 of a conventional cylindrical lock mounted on a door panel 13. The lever handle 9 then engages the driving shaft 8 in a known manner. Two bolts (not shown) then pass through the through holes 37 of the housing 3 and engage the components located on the other side of the door, so as to securely engage on the door panel 13. In consideration of aesthetic appearance, a mounting cap 10 can be disposed outside of the housing 3 in a known manner to cover the exterior of the housing 3. Alternatively, some other additional inserts can be disposed between the housing 3 and the mounting cap 10 to meet various aesthetic requirements. For example, an annular stuffing member 14 can be provided for increasing the strength of the housing 3, so that the outer surface of the housing 3 will not be indented, when an external force exerts thereon.

As illustrated in FIGS. 7 and 8, when assembled, no matter whether the level handle 9 rotates clockwise or counterclockwise, the driving shaft 8 can be rotated to drive the rotary member 4 to rotate, so that the engaging plate 45 of the rotary member 4 pushes one of the two legs 51 of the coiled spring 5. The other leg 51 of the coiled spring 5 abuts against the protrusion 36 of the housing 3, so that the coiled spring 5 can be deformed to create a resiliently biasing force for returning the lever handle 9 to its original position before it is rotated.

As clearly illustrated in FIG. 7 or 8, when the rotary member 4 is rotated for an angular displacement, the lugs 46 of the rotary member 4 abut against the protrusions 36 of the housing 3, so that the rotational angle of the rotary member 4 is limited, and so that the deformation of the coiled spring 5 is limited within the elastic limit to prevent the internal components of the cylindrical lock from damage due to inappropriate and strong torsion force created by the lever handle 9.

SUMMARY OF THE INVENTION

A primary object of the present invention is to provide a reinforced apparatus for a lever handle of a door lock, which has the characteristics of simple construction, easy assembling, and high reliability, and can be maintain the lever handle to return to its original position though after a long term of use.

A reinforced apparatus for a lever handle of a door lock according to the present invention comprises:

a housing having a first bottom plate and a second bottom plate, the first bottom plate connecting a first annular wall and a second annular wall, the second bottom plate connecting the second annular wall and a third annular wall; a recess formed between the first annular wall and the second annular wall, at least one protruding portion formed within the recess;

a rotary member including a first side plate and a second side plate, a coiled spring disposed between the first side plate and the second side plate, the coiled spring including two legs engaging the protruding portion of the housing;

characterized in that: the housing is formed with an axially arranged predetermined bending member, which can, when the rotary member and the coiled spring are disposed within the recess, be bent by an auxiliary apparatus for a predetermined angle, so that a distance R' defined between predetermined bending member and an axis of the housing is smaller than a distance r defined between the outer edge of the second side plate and an axis of the second side plate, and so that the rotary member is maintained within the recess and can be operated externally.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF PREFERRED EMBODIMENT OF THE INVENTION

Figure 1:
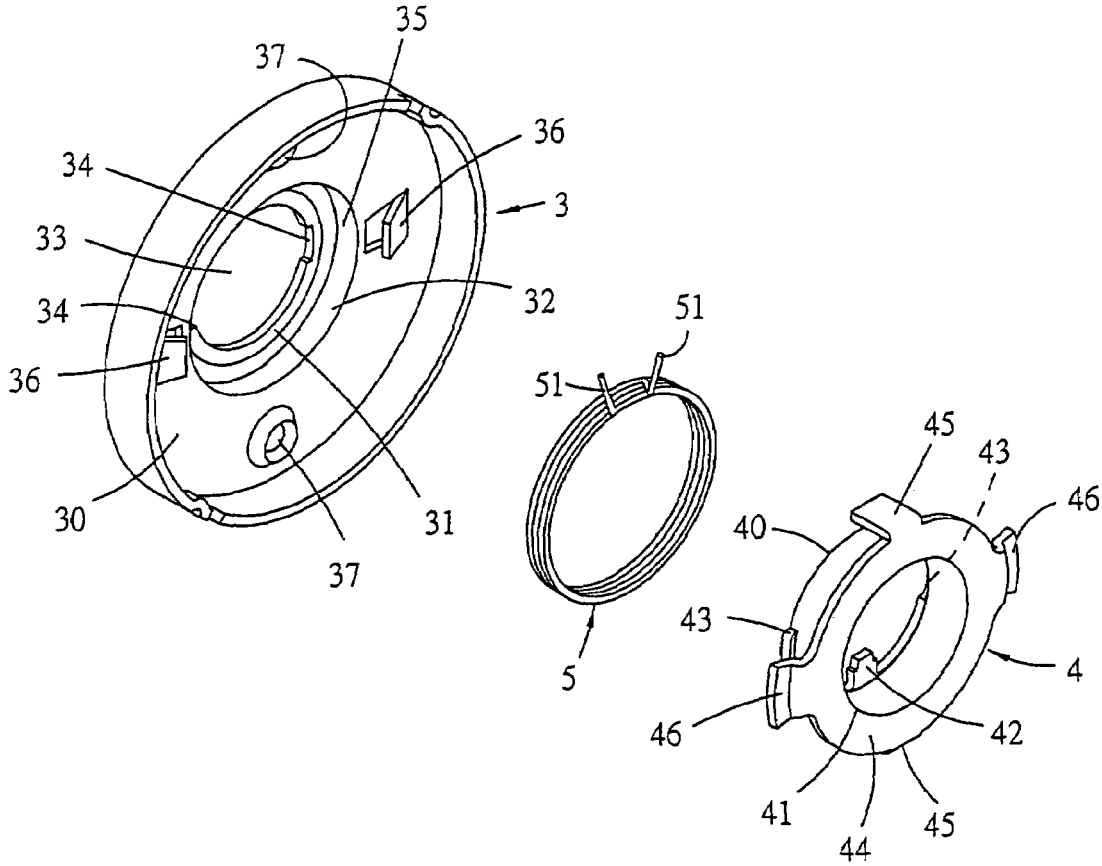
FIG. 1 (PRIOR ART)
FIG. 1 is an exploded view schematically illustrating the housing, the rotary member and the coiled spring of a first embodiment of a conventional construction.
Figure 2:
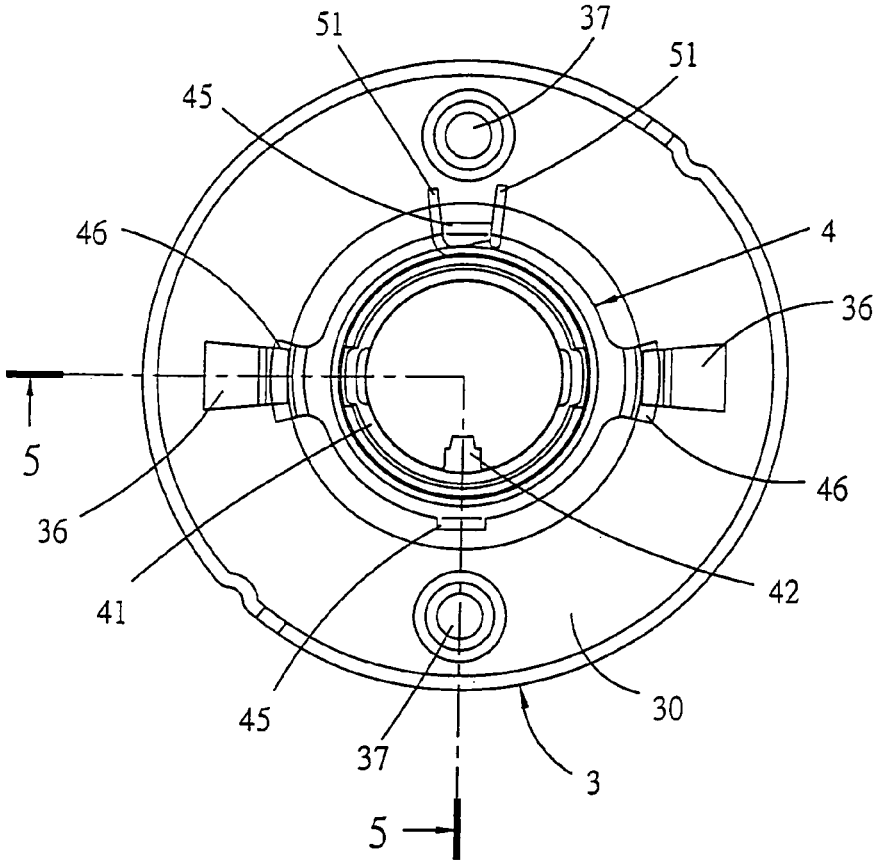
FIG. 2 (PRIOR ART)
FIG. 2 is a plan view schematically illustrating the housing, the rotary member and the coiled spring of a first embodiment of a conventional construction.
Figure 3:
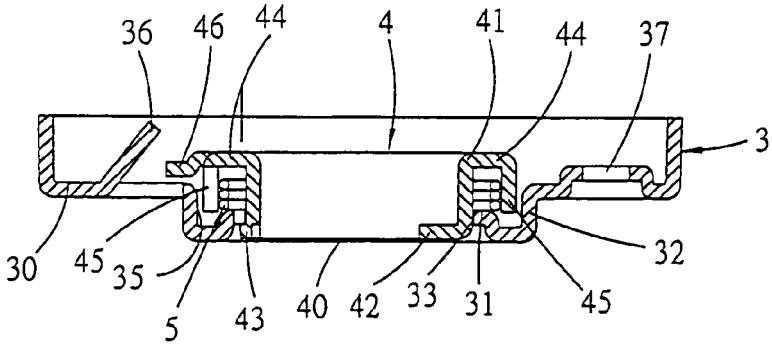
FIG. 3 (PRIOR ART)
FIG. 3 is a sectional view, taken along the line 5—5 of FIG. 2, showing the first embodiment of a conventional construction.
Figure 4:
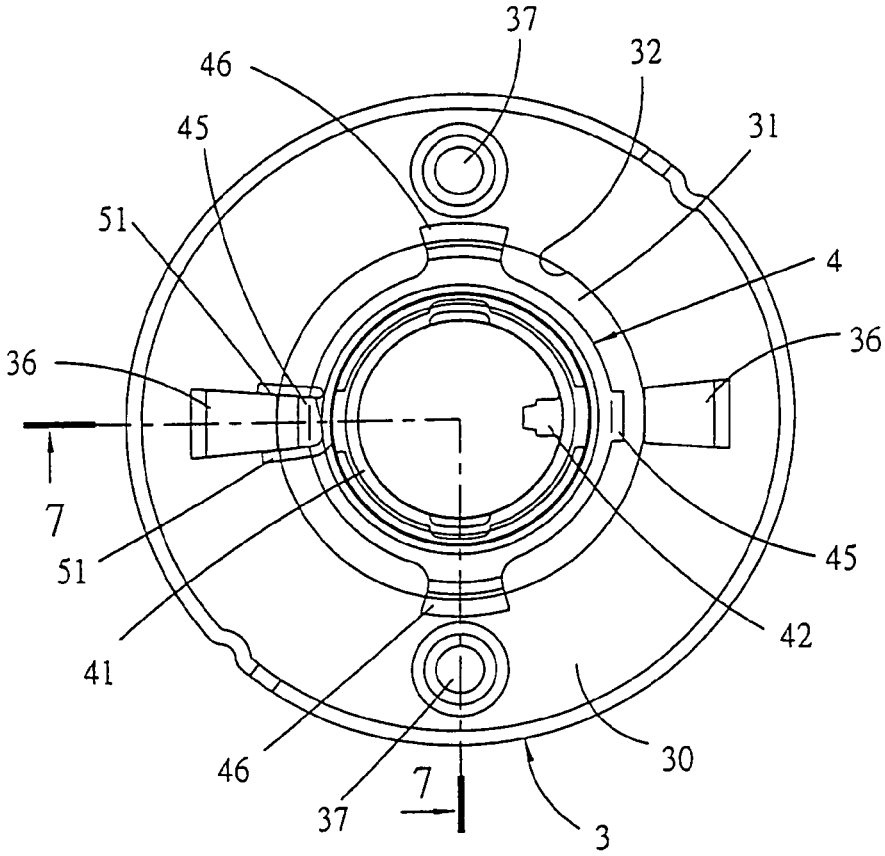
FIG. 4 (PRIOR ART)
FIG. 4 is a plan view schematically illustrating the housing, the rotary member and the coiled spring of a first embodiment of a conventional construction in an assembled condition.
Figure 5:
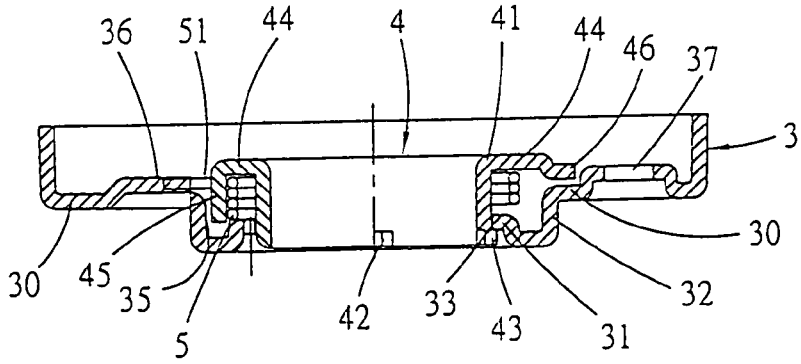
FIG. 5 (PRIOR ART)
FIG. 5 is a sectional view, taken along the line 7—7 of FIG. 4, 5 schematically showing the first embodiment of a conventional construction.
Figure 6:
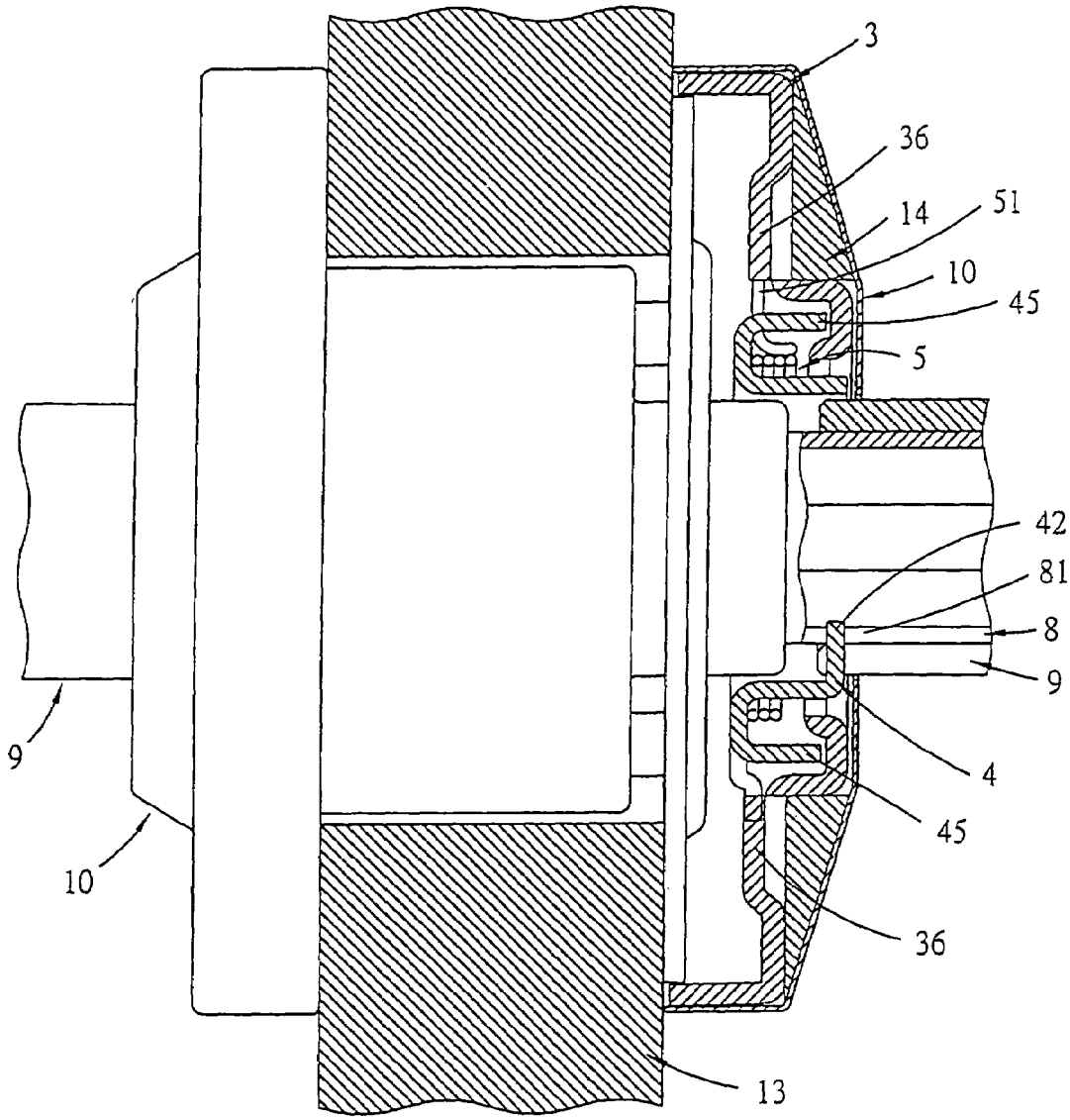
FIG. 6 (PRIOR ART)
FIG. 6 is fragmentary sectional view illustrating a conventional reinforced apparatus for a lever handle of a door lock in association with a cylindrical lock mounted on a door panel.
Figure 7:
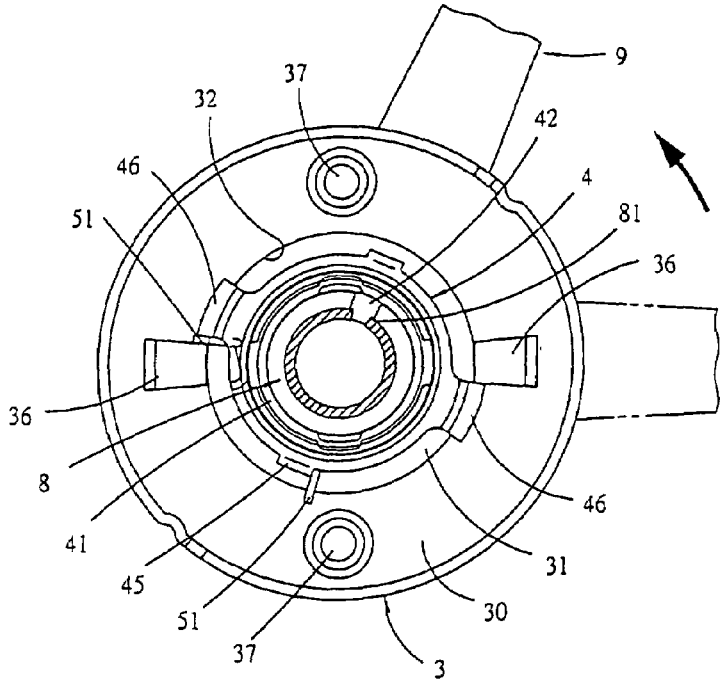
FIG. 7 (PRIOR ART)
FIG. 7 is a plan view illustrating that the rotary member and the coiled spring of the first embodiment of a conventional construction are rotated in one direction for an angular displacement by a lever handle.
Figure 8:
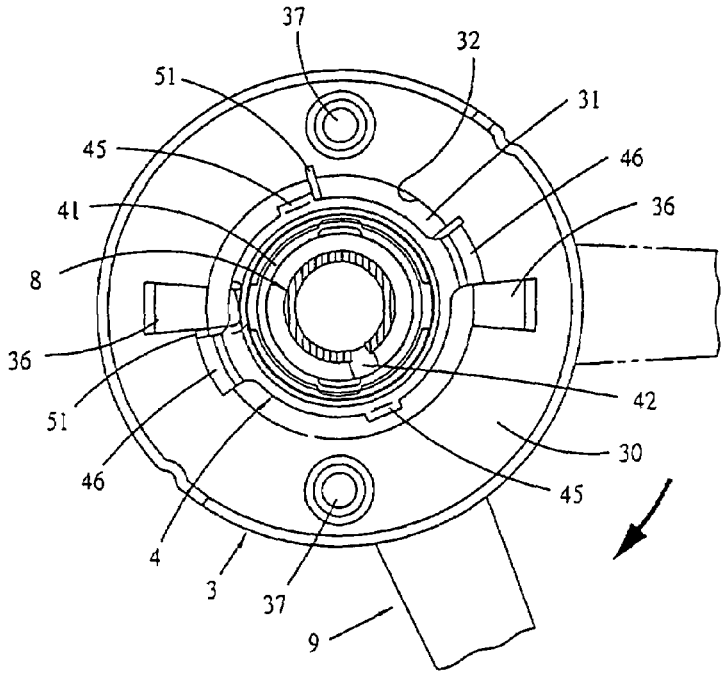
FIG. 8 (PRIOR ART)
FIG. 8 is a plan view illustrating that the rotary member and 15 the coiled spring of the first embodiment of a conventional construction are rotated in the other direction for an angular displacement by a lever handle.
Figure 9:
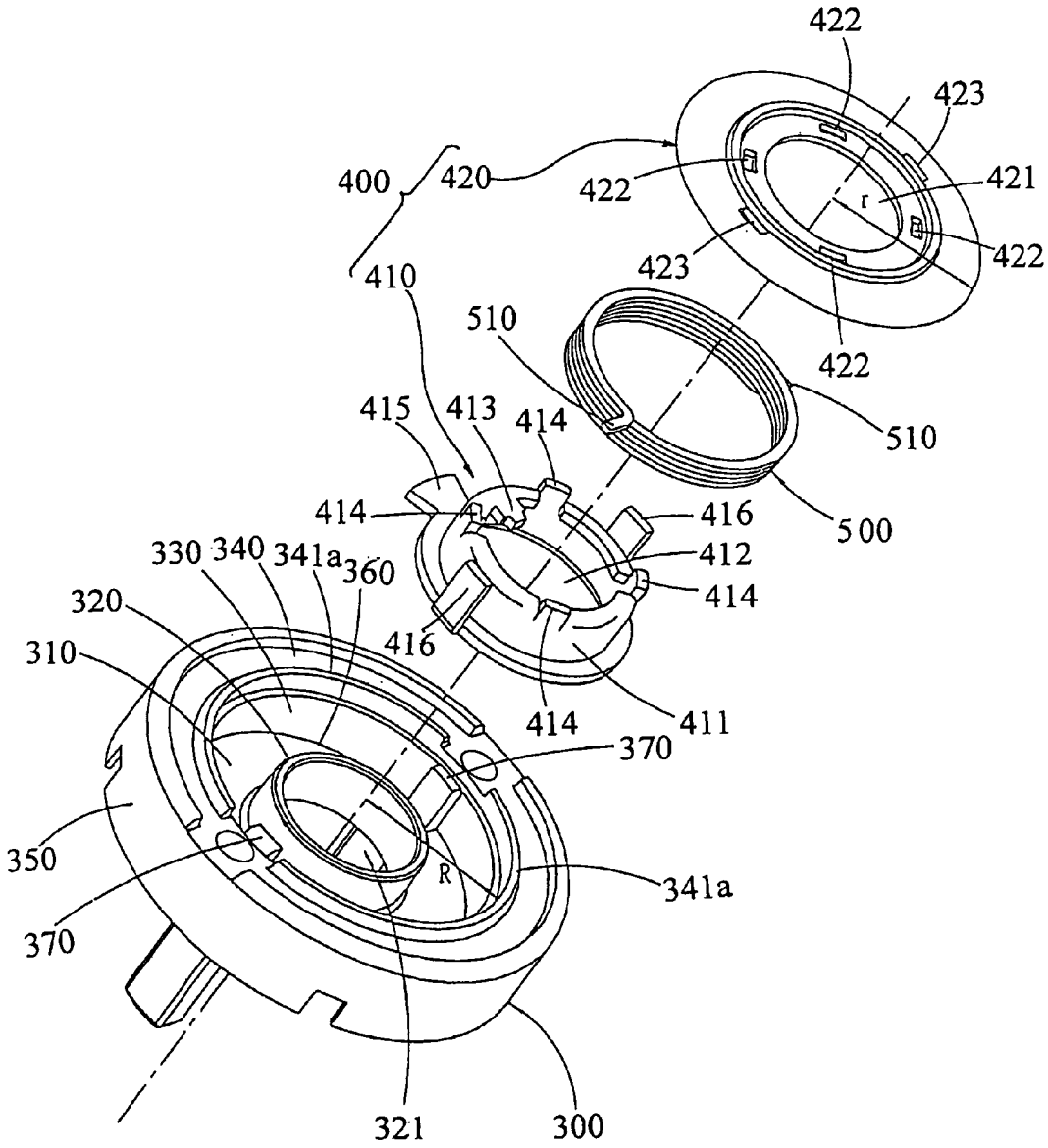
FIG. 9 is an exploded view of the first embodiment of the present invention.

With reference to FIG. 9, a reinforced apparatus for a lever handle of a door lock according to the first preferred embodiment of the present invention comprises a housing 300, a rotary member 400 and a coiled spring 500. The housing 300 includes a first bottom plate 310 and a second bottom plate 340. The first bottom plate 310 connects a first annular wall 320 and a second annular wall 330. The second bottom plate 340 connects the second annular wall 330 and a third annular wall 350. A recess to 360 is formed between the first annular wall 320 and the second annular wall 330. Two protruding portions 370 are formed within the recess 360 and are angularly spaced apart from each other. A hole 321 is formed inside the first annular wall 320. The second bottom plate 340 is formed with two axially extending and curved predetermined bending members 341*a*. The predetermined bending member 341*a* is spaced from an axis of the housing 300 for a distance R.

The rotary member 400 includes a first side plate 410 and a second side plate 420. The first side plate 410 has a plate body having an axially arranged internal ring 411 formed with a hole 412 therein. The internal ring 411 has one end formed with a radially and inwardly extending projection 413 and four axially extending protrusions 414 spaced apart from one another. The outer edge of the plate body of the first side plate 410 includes a radially and outwardly extending lug 415 and two axially extending projecting ribs 416 spaced apart from each other. The second side plate 420 is formed with a disk body having a central hole 421. Between the hole 421 and the outer edge of the second side plate 420, four slots 422 corresponding to the four protrusions 414 of the first side plate 410, and two slots 423 corresponding to the projecting ribs 416 of the first side plate 410 are formed for engagement. A distance r is defined between the outer edge of the second side plate 420 of the rotary member 400 and the axis of the second side plate 420. Before an assembling operation, a distance R defined between the predetermined bending member 341*a* of the housing 300 and the axis of the housing 300 is larger than the distance r defined between the outer edge of the second side plate 420 of the rotary member 400 and the axis of the second side plate 420, to facilitate the assembling operation.

The coiled spring 500 includes two legs 510 and is disposed around the circumference of the internal ring 411 of the first side plate 410 and between the first side plate 410 and the plate body of the second side plate 420. Two legs 510 of the spring 500 respectively abut against a corresponding projecting is rib 416 of the first side plate 410.

Figure 10:
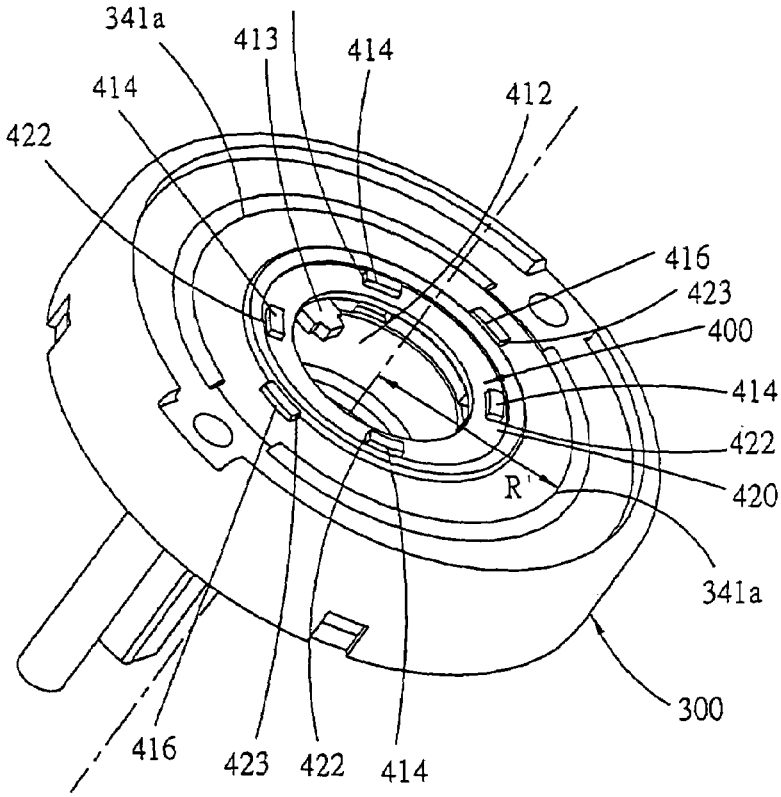
FIG. 10 is a perspective view showing the first embodiment of the present invention in an assembled condition.

In an assembling operation, the rotary member 400 is firstly disposed within the recess 360 of the housing 300, so that the two legs 510 of the spring 500 respectively abut against a corresponding protruding portion 370 of the housing 300. The two curved predetermined bending members 341*a* of the housing 300 are then bent by an auxiliary apparatus (not shown) for a predetermined angle, so that a distance R' defined between each predetermined bending member 341*a* and the axis of the housing 300 is smaller than the distance r defined between the outer edge of the second side plate 420 of the rotary member 400 and the axis of the rotary member 400, as shown in FIGS. 9 and 10, and so that the rotary member 400 and the coiled spring 500 are rotatably positioned within the recess 360 and can be operated externally.

Figure 11:
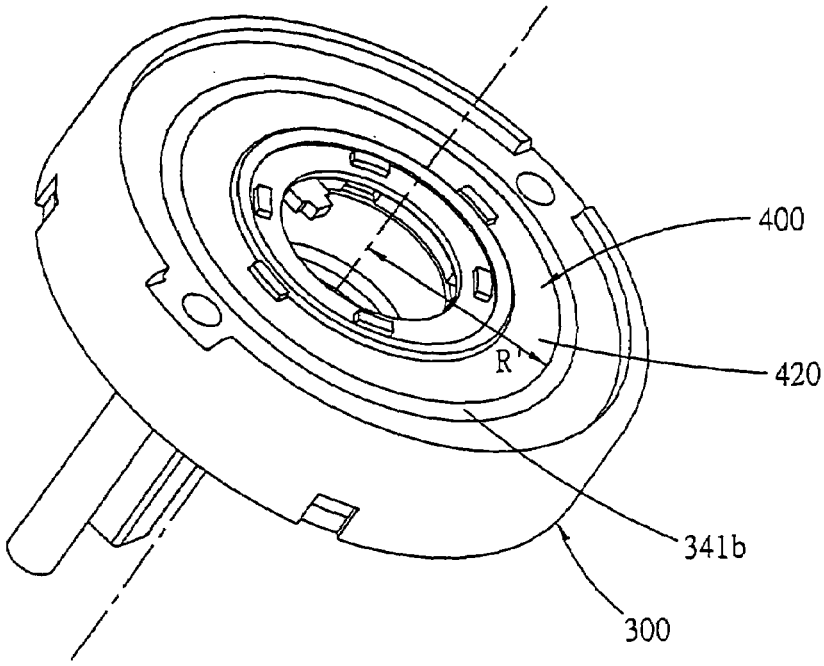
FIG. 11 is a perspective view showing the second embodiment of the present invention in an assembled condition.
Figure 12:
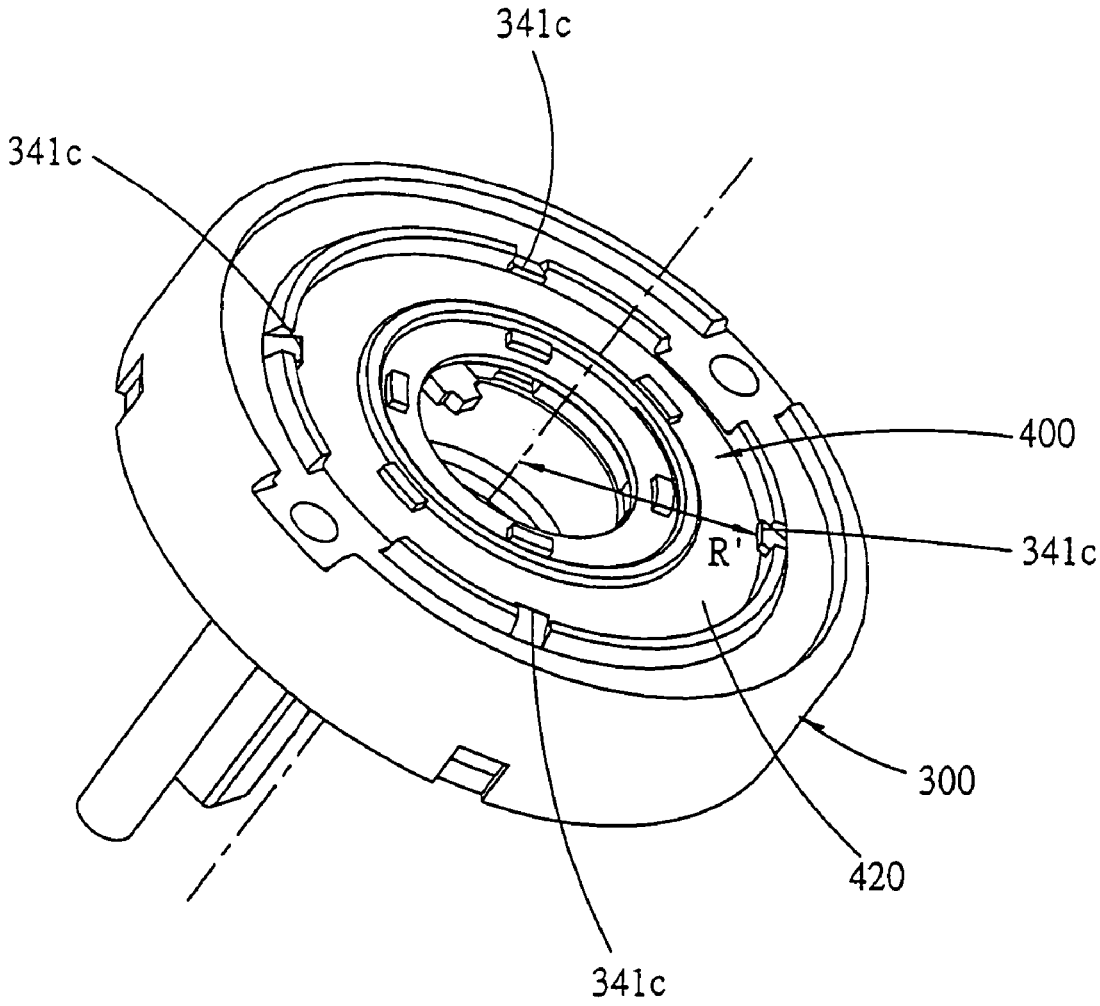
FIG. 12 is a perspective view showing the third embodiment of the present invention in an assembled condition.

The two curved predetermined bending members 341*a* of the second side plate 340 of the housing 300 according to the first preferred embodiment, in practice, can be formed as a continuous annular bending member 341*b* as shown in FIG. 11, or can be formed as several discrete predetermined bending members 341*c* as shown in FIG. 12. These constructions can also accomplish the equivalent function for maintaining the rotary member 400 within the recess 360 to be operated externally. As described above, no matter whether the predetermined bending members 341*a* of the second bottom plate 340 of the housing 300 are formed as two curved discrete bending members 341*a*, one continuous annular predetermined bending member 341*b* or several discrete curved predetermined bending members 341*c*, these construction are integrally formed with the housing 300.

Before the assembly operation, the distance R defined between the predetermined bending member 341*a* (341*b*, 341*c*) of the housing 300 and the axis of the housing 300 is larger than the distance r defined between the outer edge of the second side plate 420 of the rotary member 400 and the axis of the second side plate 420, so that the rotary member 400 and the coiled spring 500, when in assembling, can be easily disposed within the recess 360 of the housing 300. After the assembly operation, i.e., when the rotary member 400 and the coiled spring 500 have been disposed within the recess 360 of the housing 300, the predetermined bending members 341*a* (341*b*, 341*c*) are then bent inward by an auxiliary apparatus for a predetermined angle, so that a distance R□ defined between the predetermined bending member 341*a* (341*b*, 341*c*) and the axis of the housing 300 is smaller than the distance r defined between the outer edge of the second side plate 420 of the rotary member 400 and the axis of the second side plate 420, and so that the rotary member 400 and the coiled spring 500 are maintained within the recess 360 of the housing 300.

The above-described embodiment of the present invention is intended to be illustrated only. Numerous alternative embodiments may be devised by those skilled in the art without departing from the scope of the following claims.

What is claimed is:

1. A reinforced apparatus for a lever handle of a door lock, comprising:

a housing provided with a recess formed thereon and at least one protruding portion disposed at a predetermined position of the housing; and a rotary member including a first side plate, a second side plate and a coiled spring disposed between the first side plate and the second side plate, the first side plate having an axial internal ring which is formed with a radially, inward extending projection and at least one axially extending protrusion, the coiled spring having a leg for abutting against the at least one protruding portion of the housing;

wherein the housing is provided with a predetermined bending member; when the rotary member and the coiled spring are disposed within the recess, the bending member is adapted to be bent for a predetermined angle, so that a distance (R') defined from the predetermined bending member to an axis of the housing is smaller than a distance (r) defined from an outer edge of the second side plate to an axis of the second side plate, thereby keeping the rotary member positioned within the recess and operated by an external force.

2. The reinforced apparatus for a lever handle of a door lock according to claim 1, wherein the first side plate is provided with a radially, outwardly extending lug.

3. The reinforced apparatus for a lever handle of a door lock according to claim 2, wherein the first side plate is formed with at least one axially extending projecting rib spaced apart from the internal ring, so that the spring can be disposed around the internal ring, and the projecting rib abuts against the leg of the coiled spring.

4. The reinforced apparatus for a lever handle of a door lock according to claim 3, wherein the second side plate is shaped by a disk body having a hole and at least one slot formed around the hole, and wherein the slot of the second side plate is provided corresponding to the protrusion of the first side plate for engaging the protrusion of the first side plate.

5. The reinforced apparatus for a lever handle of a door lock according to claim 4, wherein the second side plate further comprises at least one slot corresponding to the at least one projecting rib of the first side plate, for engaging the at least one projecting rib of the first side plate.

* * * * *